US007497433B2

(12) United States Patent
Nagao

(10) Patent No.: US 7,497,433 B2
(45) Date of Patent: Mar. 3, 2009

(54) SHEET MATERIAL FEEDING DEVICE, IMAGE READING DEVICE, AND IMAGE FORMING DEVICE

(75) Inventor: Hiroyuki Nagao, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 308 days.

(21) Appl. No.: 10/562,971

(22) PCT Filed: Jun. 24, 2004

(86) PCT No.: PCT/JP2004/008881

§ 371 (c)(1),
(2), (4) Date: Dec. 29, 2005

(87) PCT Pub. No.: WO2005/003006

PCT Pub. Date: Jan. 13, 2005

(65) Prior Publication Data

US 2006/0157912 A1 Jul. 20, 2006

(30) Foreign Application Priority Data

Jul. 1, 2003 (JP) ..... 2003-189572

(51) Int. Cl.
*B65H 3/52* (2006.01)

(52) U.S. Cl. ..... 271/125

(58) Field of Classification Search ..... 271/121, 271/122, 124, 125; 492/28, 20, 32, 59
See application file for complete search history.

(56) References Cited

U.S. PATENT DOCUMENTS 4,287,649 A * 9/1981 Kohler ..... 492/56
5,722,026 A * 2/1998 Goto et al. ..... 399/333
5,725,209 A * 3/1998 Takahashi et al. ..... 271/122
6,030,328 A * 2/2000 Watanabe et al. ..... 492/56

FOREIGN PATENT DOCUMENTS

| | | | |
|---|---|---|---|
| JP | 58-82933 A | | 5/1983 |
| JP | 6-107356 A | | 4/1994 |
| JP | 6-263298 A | | 9/1994 |
| JP | 7-117880 A | | 5/1995 |
| JP | 7-309468 A | | 11/1995 |
| JP | 8-99734 A | | 4/1996 |
| JP | 9-39467 | * | 2/1997 |
| JP | 9-156792 A | | 6/1997 |
| JP | 10-139195 A | | 5/1998 |
| JP | 11-217134 A | | 8/1999 |
| JP | 2001-139178 A | | 5/2001 |
| JP | 2003-72966 A | | 3/2003 |

* cited by examiner

*Primary Examiner*—Patrick H Mackey
*Assistant Examiner*—Thomas A Morrison
(74) *Attorney, Agent, or Firm*—Birch, Stewart, Kolasch & Birch, LLP

(57) ABSTRACT

A sheet feeder feeds sheets fed from a document tray one by one. The sheet feeder includes a document tray (22) configured to accommodate therein a stack of sheets; a pickup roller (R1) configured to contact the stack of sheets and feed the sheets toward a feed path; and a feed roller (R2) and a reverse roller (R2*a*) which are located downstream of the pickup roller (R1), the reverse roller (R2*a*) including an inner sponge member (SP) having an outer periphery formed with a coating layer (Ct) having a surface smoothed to such an extent as to have a gloss.

7 Claims, 8 Drawing Sheets

FIG. 7

| | WEIGHT 200 gf | WEIGHT 550 gf |
|---|---|---|
| ROLLERS TO BE MEASURED | PULLOUT FORCE (gf) | PULLOUT FORCE (gf) |
| EPDM ELEPHANT-SKIN ABRASION FINISHED (HARDNESS 33) | 180 – 190 | 500 - 510 |
| EXPANDED NBR (HARDNESS 30) + URETHANE COAT (ROUGH SURFACE) | 160 - 170 | 420 - 430 |
| EXPANDED NBR (HARDNESS 30) + URETHANE COAT (GLOSSY SURFACE) | 100 - 110 | 220 - 230 |

FIG. 8

(UNIT: μm)

| SURFACE ROUGHNESS | EPDM ABRASION FINISHED (CONVENTIONAL) | EXPANDED NBR + URETHANE COAT | |
|---|---|---|---|
| | | ROUGH | GLOSSY – SLIGHTLY ROUGH |
| MEAN ROUGHNESS Ra | 1.30 - 1.61 | 0.28 - 0.29 | 0.09 - 0.11 |
| MAXIMUM HEIGHT Ry | 6.20 - 8.77 | 0.98 - 1.28 | 0.46 - 0.60 |
| TEN-POINTS MEAN ROUGHNESS Rz | 5.46 - 7.07 | 0.90 - 0.93 | 0.39 - 0.80 |
| MAXIMUM ROUGHNESS Rmax | 62.34 - 142.24 | 61.26 - 96.59 | 13.20 - 35.36 |
| EVALUATION OF STAIN CAUSED BY RUBBING | × | △ | ◎ - ○ |

SHEET MATERIAL FEEDING DEVICE, IMAGE READING DEVICE, AND IMAGE FORMING DEVICE

TECHNICAL FIELD

The present invention relates to a sheet feeder for feeding documents, and to an image reading apparatus and an image forming apparatus.

BACKGROUND ART

In recent years, efficient image reading and image formation has been realized by the use of a document reader set on an image forming apparatus or a like apparatus, the document reader being configured to automatically feed and sequentially read sheet-shaped documents. Further, with the progress of digital technology, speeds at which reading of a document, conversion to electronic data and image formation from electronic data are performed have been increased and, hence, it has become possible to process a larger number of document sheets at a high speed. The number of document sheets that can be set on such a document reader at a time has increased to a very large number, for example, about 100 to 200. At the same time, with the progress of the document feeder section of the document reader, types of document sheets that can be fed by such a document feeder section have been diversified.

An image reading apparatus which is configured to feed a large number of sheets such as document sheets set thereon and read the images of the document sheets as described above picks up the sheets one by one before reading. In order to feed only one of plural document sheets placed on a document tray to a document reader section, the image reading apparatus uses separator which comprises a feed roller and a reverse roller and which is configured such that if plural document sheets are picked up, the reverse roller returns a document sheet in contact therewith to the document tray while the feed roller feeds only one document sheet in contact therewith to a feed path continuous with the document reading section.

The reverse roller of the separator is connected to a driving section for receiving rotating force reverse of the direction of rotation of the feed roller via a torque limiter. With a torque loaded when only one document sheet is nipped by the separator, the reverse roller slips relative to the driving section to rotate together with the document sheet, thus allowing only the single document sheet to pass through the separator. However, when two or more document sheets are about to be nipped, the loaded torque varies to cause the torque limiter to prevent the reverse roller from slipping, so that the reverse roller rotates in the direction opposite to the document feed direction to allow only one document sheet to be fed reliably.

In cases where the reverse roller used is a conventional solid-type reverse roller which is hard to slip, if such an image as a letter or a picture is written on the side of a document sheet coming to contact the reverse roller using a pencil, ink having a poor fixing property, or the like, a problem arises that an image trailing phenomenon occurs such that the image runs due rubbing by the reverse roller, which results in degradation in the quality of the image to be read from the side of the document sheet having been brought into contact with the reverse roller. Thus, the quality of data read and the quality of the image formed using such data are degraded and, at the same time, the condition of the document sheet is deteriorated considerably.

In attempt to overcome such a drawback as well as to improve the separation performance, feed performance and the like, various reverse rollers formed from soft materials have hitherto been proposed. For example, a sheet feeder has been proposed which comprises feed rotation means (feed roller) and separating rotation means (reverse roller) formed from a material having a lower hardness than the feed rotation means (see patent document 1). This patent document describes the feature that: when the separating rotation means and the feed rotation means are pressed against each other, the resulting nip has a shape dented on the separating rotation means side; and if plural sheets are introduced into the nip zone by pickup means, all the introduced sheets are able to directly contact the separating rotation means. The separating rotation means comprises a sponge retard roller having an outer peripheral surface formed with a coating layer by uniformly spray-coating the outer peripheral surface with a urethane solution comprising the same material as the sponge retard roller.

Also, a proposal has been made of an arrangement comprising: a feed roller having an outer peripheral layer formed of a high wear-resistance rubber material and an intermediate layer formed of a vibration-absorptive rubber material which is provided between the outer peripheral layer and a roller shaft; and a reverse roller pressed against the feed roller, the reverse roller being formed of a rubber material having a lower hardness than the outer peripheral layer (see patent document 2). This patent document describes the feature that the intermediate layer stabilizes the sheet feed pressure thereby increasing the sheet feed power and considerably reducing sound of separation.

Another proposal has been made of an arrangement wherein a paper feed member comprises an elastic member having a hollow therein (see patent document 3). This patent document describes the feature that the provision of the hollow allows a portion of the feed member contacted by paper to collapse deeply, so that the area in contact with paper increases to ensure reliable paper feeding. Yet another proposal having been made is for improvement to stabilize the supported condition of such a paper feed member having a hollow (see patent document 4).

Patent document 1: JP H07-117880 A
Patent document 2: JP S58-082933 A
Patent document 3: JP H06-263298 A
Patent document 4: JP H11-217134 A

DISCLOSURE OF THE INVENTION

Problems to be Solved by the Invention

In the arrangement described in patent document 1, the sponge retard roller serving as the separating rotation means has the outer peripheral surface formed with the coating layer by uniformly spray-coating the outer peripheral surface with the urethane solution. For this reason, the arrangement has a drawback that very complicated spraying process and increased cost are required.

With the arrangement described in patent document 2, the separating roller pressing against the feed roller has a very complicated structure comprising a reverse roller and a driven roller, which results in an increased parts count, hence, increased cost. In addition, because the outer peripheral surfaces of respective of the reverse roller and the driven roller are different in hardness from each other, the force pressing against a sheet material becomes non-uniform widthwise of the sheet material and, hence, the sheet feed pressure working in a direction orthogonal to the sheet feed direction is distributed non-uniformly. For this reason, it is concerned about that deformation or wrinkling of the sheet material is likely in the case where the sheet is thin or has a low rigidity, or in like cases.

The arrangements described in patent documents 3 and 4 can be judged as having an improved feed capability because the provision of the hollow in the paper feed member allows the area of the paper feed member in contact with paper to increase in feeding paper thereby ensuring a high feed pressure. However, these patent documents are completely silent on the smoothness of the surface of the paper feed member for contact with a sheet material. If the contact surface is not smooth, even though the paper feed member is formed of an elastic material, it is concerned about that the trailing phenomenon that the image formed on the sheet material is caused to stretch due rubbing by a high feed pressure during feeding.

The present invention has been made in view of such circumstances. Accordingly, it is an object of the present invention to provide a sheet feeder capable of reliably feeding document sheets one by one without any degradation in the condition of each document sheet while preventing plural document sheets from being fed as remaining superposed one upon another.

Means for Solving the Problem

The present invention provides the following means for solving the aforementioned problems.

(1) A sheet feeder comprising: a sheet accommodating section configured to accommodate therein a stack of sheets; a sheet pickup section configured to contact the stack of sheets and feed the sheets toward a feed path; and sheet separator located downstream of the sheet pickup section and comprising a feed roller and a reverse roller, the reverse roller including a sponge member having an outer periphery formed with a coating layer having a surface smoothed to such an extent as to have a gloss.

With this construction wherein the reverse roller has the sponge member forming an elastic layer and the outer periphery of the sponge member is formed with the coating layer having a glossy and smooth surface, the reverse roller can be brought into contact with a sheet uniformly, have an increased contact area in which partial contact pressures are lowered and distributed uniformly. Accordingly, it is not likely that a sheet surface is rubbed excessively and that the trailing phenomenon that an image formed on the sheet surface is stretched if the image is written with pencil or has a low fixing property for example. Thus, the sheet feeder can prevent the image quality from degrading due to the sheet surface being stained or the image being made unclear and hence handle sheets favorably.

In another embodiment of the present invention, the coating layer is formed by dipping the sponge member into a coating liquid.

With this feature, the coating layer formed by dipping has a smoother surface than that formed by spraying or a like process. Thus, the occurrence of the trailing phenomenon can be avoided. In addition, the reverse roller can be manufactured at a reduced cost.

In yet another embodiment of the present invention, the coating layer comprises urethane rubber.

With this feature, the coating layer comprising the urethane rubber is formed by dipping and, hence, the reverse roller imparted with a superior durability can be provided at a low price.

In yet another embodiment of the present invention, the coating layer has a mean surface roughness Ra satisfying the following formula (1):

$$0.09 \leqq Ra \leqq 0.11 \quad (1).$$

With this feature, the coating layer having a mean surface roughness Ra established to satisfy the formula (1) can have a surface smoothed to such an extent as to have a gloss. Accordingly, the sheet feeder can prevent the image quality from degrading due to the occurrence of the trailing phenomenon of an image formed on a sheet surface if the image written is with pencil or has a low fixing property for example, or due to the sheet surface being stained or the image being made unclear, and hence can handle sheets favorably.

It has been confirmed that the surface roughness of the coating layer preferably has a maximum height Ry, a ten-points mean roughness Rz and a maximum roughness Rmax which are established to satisfy respective of the following formulae (2) to (4):

$$0.46 \leqq Ry \leqq 0.60 \quad (2)$$

$$0.39 \leqq Rz \leqq 0.80 \quad (3)$$

$$13.20 \leqq Rmax \leqq 35.36 \quad (4).$$

By thus establishing these characteristics, the surface of the coating layer can be smoothed to such an extent as to have a gloss.

In a still another embodiment of the present invention, the sheet pickup section comprises a roller member having a hollow portion therein.

With this feature, the use of the roller member having a hollow portion therein for the sheet pickup section makes it possible to establish a lower and more uniform pressing force against a sheet than does a conventional solid-type pickup section, as well as to increase the sheet contact area. Thus, the sheet pickup section is capable of picking up only the sheet contacting the sheet pickup section and hence reducing the frequency of occurrences of feed of plural sheets remaining superposed one upon another.

By thus combining the hollow pickup section with the sheet separator, it is possible to reduce the frequency of occurrences of feed of plural sheets remaining superposed one upon another, lower the possibility that the reverse roller rubs a sheet, inhibit the occurrence of staining of a sheet or trailing of an image, and maintain a sheet in a good condition.

The sheet feeder according to the present invention can be applied to an image reading section configured to read an image formed on the sheet fed by the sheet feeder. Such an image reading apparatus is capable of reading image data with high precision since the sheet feeder can prevent the image quality from degrading due to the sheet being stained or the image being made unclear by the trailing phenomenon which occurs if, for example, the image is written with pencil or has a low fixing property.

ADVANTAGE OF THE INVENTION

As apparent from the foregoing description, the present invention has the following advantages.

By the provision of the arrangement wherein the reverse roller has the sponge member forming the elastic layer thereof and the outer periphery of the sponge member is formed with the coating layer having a glossy and smooth surface, the reverse roller can be brought into contact with a sheet uniformly, have an increased contact area in which partial contact pressures are lowered and distributed uniformly. For this reason, it is not likely that a sheet surface is rubbed excessively. Thus, the sheet feeder can prevent the image quality from degrading due to the sheet being stained or the image being made unclear by the trailing phenomenon which occurs if, for example, the image is written with pencil or has a low fixing property, and hence can handle sheets favorably.

Since the coating layer is formed by dipping, the coating layer has a smoother surface than that formed by spraying or a like process. Thus, the occurrence of the image trailing (stretching) phenomenon can be avoided. In addition, the reverse roller can be manufactured at a reduced cost.

Since the coating layer comprising urethane rubber is formed by dipping, the reverse roller imparted with a superior durability can be provided at a low price.

Since the mean surface roughness Ra of the coating layer is established to satisfy the formula (1), the surface of the coating layer can be smoothed to such an extent as to have a gloss. Thus, the sheet feeder can prevent the image quality from degrading due to the sheet being stained or the image being made unclear by the trailing phenomenon which occurs if, for example, the image is written with pencil or has a low fixing property, and hence can handle sheets favorably.

The use of the roller member having a hollow portion therein for the sheet pickup section makes it possible to establish a lower and more uniform pressing force against a sheet than does a conventional solid-type pickup section, as well as to increase the sheet contact area. Thus, the sheet pickup section is capable of picking up only the sheet contacting the sheet pickup section and hence reducing the frequency of occurrences of feed of plural sheets remaining superposed one upon another.

By thus combining the hollow pickup section with the sheet separator, it is possible to reduce the frequency of occurrences of feed of plural sheets remaining superposed one upon another, lower the possibility that the reverse roller rubs a sheet, inhibit the occurrence of staining of a sheet or trailing of an image, and maintain a sheet in a good condition.

Since the sheet feeder can prevent the image quality from degrading due to the sheet being stained or the image being made unclear by the trailing phenomenon which occurs if, for example, the image is written with pencil or has a low fixing property, image data can be read with high precision.

Since the sheet feeder can prevent the image quality from degrading due to the sheet being stained or the image being made unclear by the trailing phenomenon which occurs if, for example, the image is written with pencil or has a low fixing property, it is possible to read image data with high precision, improve the image reproducibility in image formation, and ensure a high image quality.

Since the sheet feeder can prevent the image quality from degrading due to the sheet being stained or the image being made unclear by the trailing phenomenon which occurs if, for example, the image is written with pencil or has a low fixing property, it is possible to read image data with high precision, improve the image reproducibility in image formation, and ensure a high image quality.

BRIEF DESCRIPTION OF THE DRAWINGS

FIG. 7 is a table showing results of measurement of sheet pullout forces.

FIG. 8 is a table showing results of evaluation of stain caused by reverse roller R2*a* rubbing an image written on a document sheet with pencil.

BEST MODE FOR CARRYING OUT THE INVENTION

Hereinafter, a sheet feeder and an image reading apparatus including the sheet feeder according to an embodiment of the present invention will be described in detail with reference to the drawings.

Figure 1:
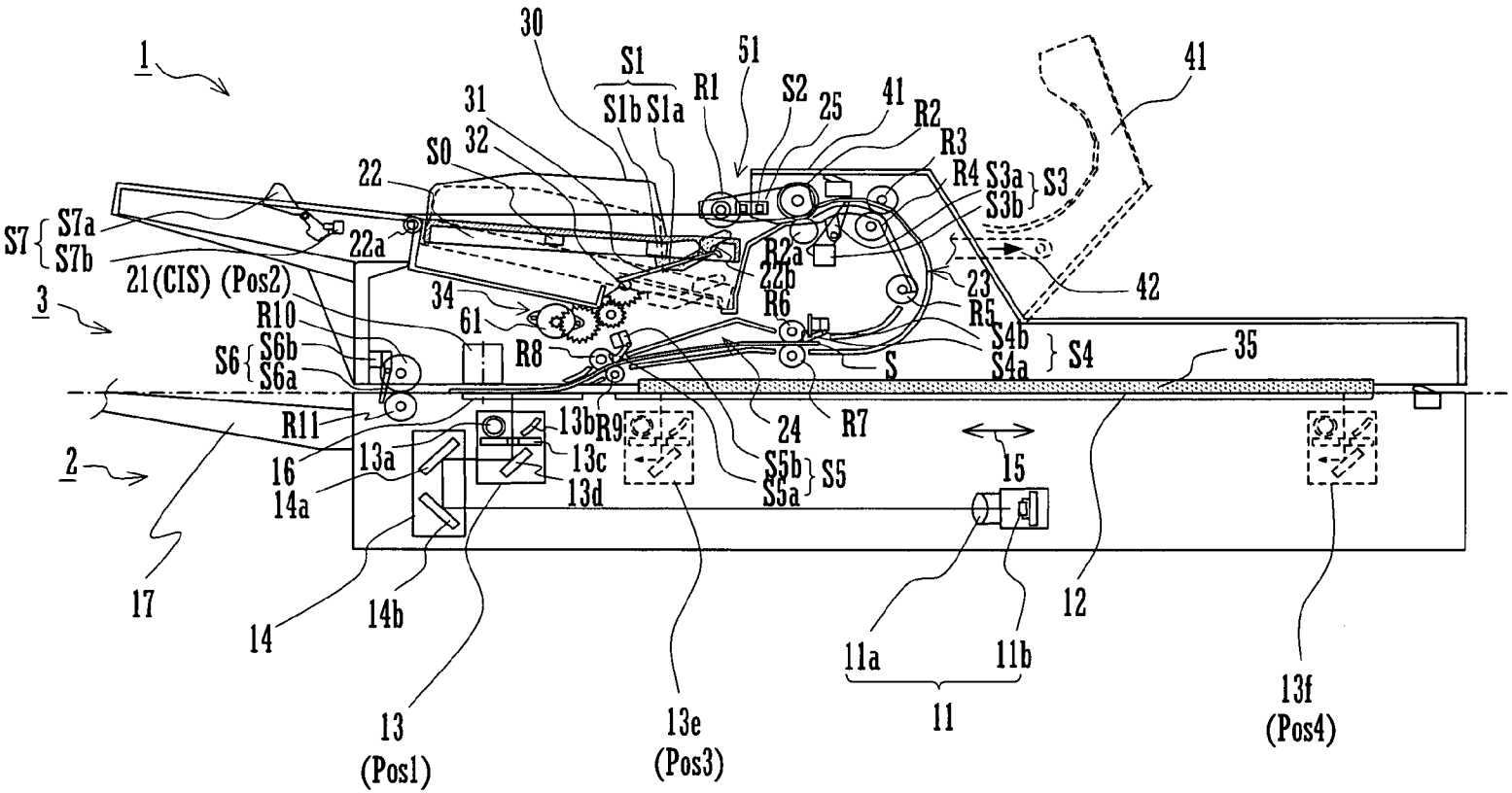
FIG. 1 is a view showing the construction of an image reading apparatus according to an embodiment of the present invention.

FIG. 1 is a vertical sectional view showing the overall construction of an image reading apparatus 1 according to one embodiment of the present invention. The image reading apparatus 1, which generally comprises an optical system 2 and an ADF (Automatic Document Feeder) 3 disposed above the optical system 2, can be used as a scanner of a copying machine or facsimile apparatus and is capable of reading both sides of a document (corresponding to a sheet defined by the present invention).

The optical system 2 includes a CCD (Charge Coupled Device) reading unit 11 as first reading means. The optical system 2 performs image reading by using a light source unit 13 and a mirror unit 14 to form an image of the document, which is placed flat on a platen 12, on the CCD reading unit 11 fixed at a predetermined position. The CCD reading unit 11 includes an imaging lens 11*a*, a CCD image sensor 11*b*, and the like.

The light source unit 13 comprises a light source 13*a*, a mirror 13*b* for condensing illuminating light for image reading emitted from the light source 13*a* onto a predetermined image reading position on the platen 12, a slit 13*c* allowing only reflected light from the document to pass therethrough, and a mirror 13*d* for changing the direction of the optical path of the light having passed through the slit 13*c* by 90°. The mirror unit 14 comprises a pair of mirrors 14*a* and 14*b* for changing the direction of the optical path of light from the light source unit 13 by 180°.

When the light source unit 13 moves at a velocity V, the mirror unit 14 moves at a velocity of V/2. The scanning unit 13 moves in the direction of arrow 15 (secondary scanning direction) to such positions as indicated by reference characters 13*e* and 13*f* to read the document image. Though not illustrated, the CCD reading unit 11 may be structured to move a unit of an optical reading system for reduced-size reading or actual-size reading comprising at least CCD image sensor 11*b*, imaging lens 11*a* and light source 13*a* for scanning at a velocity V.

The optical system 2 further includes another platen 16 spaced apart from glass 12 in the secondary scanning direction. The optical source unit 13 held stationary at a displaced position below the platen 16 can read the image on one side (hereinafter will be defined as an obverse side) of a document sheet being transported over the platen 16. Adjacent the outlet for the document sheet thus transported is provided an ejected sheet tray 17.

The ADF 3 includes a CIS (Contact Image Sensor) 21 as second reading means and feeds document sheets stacked on a document tray (corresponding to the sheet accommodating section defined by the present invention) 22 one by one. The CIS reads the image on the other side (hereinafter will be defined as a reverse side) of a document sheet.

For this purpose, the ADF 3 further comprises different types of rollers R1 to R10, detectors S1 to S7, curved feed path 23, and a registration/skew-correction region 24. The CIS 21 is a contact image sensor comprising an array of image sensors, an array of light guide means (for example a lens array of selfoc lenses), a light source (an LED array light source or a fluorescent lamp), and the like.

When optical document detector S1 comprising an actuator S1*a* and a sensor body S1*b* detects the fact that a document has been set on the document tray 22, lifting of the document tray 22 is started at a predetermined timing. When a pickup roller position detector S2 detects the fact that the uppermost sheet of the document stack has pressed up the pickup roller (corresponding to the sheet pickup section defined by the present invention) R1 which is supported by an arm 25 for up-and-down movement, the lifting of the document tray 22 is stopped temporarily to assume a standby state.

In the case where a signal to start the image reading is not inputted for a predetermined period after the document tray 22 carrying the document sheets has been held in the standby state following the lifting, the document tray 22 is preferably lowered to a predetermined level to stand by at that position in order to prevent the pickup roller R1 from being deformed, although the standby state of the document tray 22 at the lifted position may be maintained.

When a signal to start the feeding of the document sheets is inputted, the pickup roller R1 is rotated so that the sheets are picked up one by one from the uppermost one of the document stack. On the downstream side of the pickup roller R1 are disposed feed roller (separating roller) R2 and reverse roller R2*a* which serve as sheet separator. The pickup roller R1 is supported by the arm 25, which is pivotally supported by the rotating shaft of the feed roller R2.

The pickup roller R1 becomes abutting against the document by its own weight or by a biasing force. A stopper, which will be described later, prevents the pickup roller R1 from lowering more than necessary. The arm 25 is formed with a projection, while the pickup roller position detector S2, which comprises a photosensor and the like, detects the height of the pickup roller R1 based on the pivoting angle of the arm 25.

In this embodiment, the projection is provided on the arm 25 as noted above for allowing the pickup roller position detector S2 to detect the position of the pickup roller R1 directly. However, the pickup roller position detector S2 may be located as spaced apart from the arm 25. In such a case, the height of the arm 25 may be detected by utilizing coupling means such as a link mechanism. It is to be noted that the document tray 22, pickup roller R1, feed roller R2 and reverse roller R2*a* described above constitute the sheet feeder 51 according to the present invention.

The reverse roller R2*a*, which is provided with a torque limiter, is arranged to confront the feed roller R2 so that the document sheets are reliably fed one by one separately without feeding document sheets remaining superposed one upon another. Therefore, even when plural document sheets are collectively taken in by the pickup roller R1, only the uppermost sheet intimately contacting the pickup roller R1 is fed toward the curved feed path 23 by the feed roller R2 and reverse roller R2*a*.

Sheet feed detector S3, which comprises an actuator S3*a* and a sensor body S3*b*, detects whether or not the feed roller R2 and reverse roller R2*a* have separated and fed a single sheet properly. Thereafter, the document sheet thus fed is guided to the curved feed path 23 on the downstream side at a predetermined timing.

The document sheet is then transported along the curved feed path 23 by means of feed rollers R3 to R7. Sheet feed detector S4, which comprises an actuator S4*a* and a sensor body S4*b*, for detecting the passage of each document sheet through the curved feed path 23, detects whether or not each document sheet is guided smoothly. The curved feed path 23 is designed to have such a curvature as to allow any kind of document sheet, even the thickest or the stiffest document sheet among readable documents, to be transported stably.

An openable external cover 41 is provided on the apparatus body so as to cover the curved feed path 23 and the feed roller R2 and reverse roller R2*a*. The external cover 41 in an open state is depicted with broken line. There is also provided a coupling lever 42 for causing the support mechanism of the reverse roller R2*a* to act cooperatively with the open/close movement of the external cover 41. Though not shown, the coupling lever 42 may be configured not to act along with the external cover 41 but to be operated from the outside of the apparatus body.

Each document sheet outgoing from the curved feed path 23 is transported to the registration/skew-correction region 24. When the leading edge of each document sheet is detected by sheet feed detector S5 disposed at a location just short of reaching a pair of register rollers R8 and R9 located adjacent the outlet of the registration/skew-correction region 24, the register rollers R8 and R9 are stopped to allow the document sheet to collide against the rollers R8 and R9 by the feeding force from the upstream side for a predetermined period, whereby registration and skew-correction of the sheet are performed. The sheet feed detector S5 comprises an actuator S5*a* and a sensor body S5*b*.

For the registration and skew-correction described above to be achieved properly, the registration/skew-correction region 24, which extends between the most downstream feed rollers R6,R7 on the curved feed path 23 and the register rollers R8,R9, is so designed that each document sheet S can be kept substantially flat between the pair of rollers R6,R7 and the pair of rollers R8,R9 without the possibility of deformation caused by the guide surface of the feed path.

It is simply necessary for the distance between the pair of rollers R6,R7 and the pair of rollers R8,R9 to be set not smaller than the length, extending in the feed direction, of a document sheet of the smallest size among document sheets which can be handled by the sheet feeder. Thus, the smaller the trailing edge portion of the document sheet remaining in the curved feed path 23 is, the more smoothly the registration and skew-correction can be performed.

After the document sheet has been finished with the registration and skew-correction, the feeding of the document sheet is restarted at a predetermined timing and the document sheet is guided to a first read position (traveling document read position) Pos1 for exposure and scanning of the obverse side of the document sheet. Subsequently, the document sheet passes through a second read position Pos2 for exposure and scanning of the reverse side of the document sheet. The light source unit 13 is disposed to face the first read position Pos1, whereas the CIS 21 disposed to face the second read position Pos2.

The document sheet having been subjected to image reading from the obverse side thereof or from both of the obverse and the reverse sides thereof is ejected by ejecting rollers R10 and R11 (the ejecting roller R11 located on the optical system 2 side) onto ejected sheet tray 17 supported on a lateral side of the image reading apparatus 1 at a position lower than the document ejection point. Sheet ejection detector S6 comprising an actuator S6*a* and a sensor body S6*b* detects the ejection of each document sheet. The operation described above is repeated until the document sheets set on the document tray 22 run out. All the document sheets having been finished with image reading are successively ejected onto the ejected sheet tray 17.

As the document sheets are fed successively, the height of the document stack on the document tray 22 lowers. Therefore, monitoring is conducted so that, when the height of the document stack lowers to a certain level, the tray 22 is lifted by an amount corresponding to the amount of drop of the position of the pickup roller R1 to maintain the proper positional relationship between the uppermost sheet of the document stack and the pickup roller R1. For this purpose, the document tray 22 is made pivotable about a supporting point 22*a* and can be lifted when a rib 22*b* provided at an end opposite from the supporting point 22*a* is pressed up by a lifting plate 31.

An end of the lifting plate 31 opposite from the end provided with the rib 22*b* is fixed to a plate support shaft 32. The plate support shaft 32 is driven for rotation by a lift motor 61 via a lift mechanism 34 comprising a train of transmission members (gears).

A controller, which will be described later, controls a lift motor 61 of the lift mechanism 34 based on an actuating signal from the pickup roller position detector S2 so that the position of the document tray 22 in the standby state is maintained. The position of the tray 22 is selectable as desired depending on the number of document sheets which is likely to be set frequently, and the selected position can be set in advance by a serviceman or a user from a control section, which will be described later.

Further, the document tray 22 is movable up and down within the height range necessarily defined between the inlet side and the outlet side of the curved feed path 23 configured to assure stable document feed, as described above. Such vertical displacement of the tray 22 allows a large number of document sheets to be stacked on the tray 22. At the same time, the document tray 22 is capable of raising the level of the uppermost one of such a large number of document sheets stacked thereon to a position allowing the document sheets to be fed to the inlet of the curved feed path 23, whereby the document sheets can be successively fed one by one.

The document tray 22 is provided with a document restricting plate 30 for aligning side edges of the document sheets. The position of the document restricting plate 30 is detected by document size detector S0 and the position thus detected is utilized in sheet selection for image formation, as well as in the height control over the document tray 2 according to the present invention, which will be described later.

In reading a document sheet placed on the platen 12, the light source unit 13 moves from the position Pos3 (start position in stationary document reading) toward the position Pos4 (return position in reading a document sheet of a maximum length) in FIG. 1 by a predetermined distance depending on the size of the document sheet detected by the document size detector S9 or the like which is not shown in FIG. 1. On the other hand, reading of a document sheet under feeding is performed with the light source unit 13 kept stationary at the position Pos1. Based on the detection result obtained by the detector of the position of the light source unit 13, any one of the position Pos3, the position Pos4, and an intermediate position between Pos3 and Pos1 can be used as the home position at which the light source unit 13 is kept stationary in the standby state where it is not used.

To allow a document on the platen 12 to be read, the ADF 3 can pivot upward about a hinge (not shown) provided on the rear side of the image reading apparatus 1 (the deeper side in the figure) at a location between the ADF 3 and the optical system 2. With this arrangement, the upper surface of the platen 12 of the image reading apparatus 1 can be exposed from the front of the figure so that a document that cannot be fed, such as a book, can be set on the platen 12. A document mat 35 is provided on the ADF 3 side so as to face the platen 12.

The image reading apparatus 1 thus constructed can perform document reading in three modes, i.e., a stationary document reading mode, a traveling document reading mode and a both-sides reading mode. The stationary document reading mode is a mode for reading such a document as a book placed on the platen 12 by using the CCD reading unit 11 while moving the light source unit 13 and the mirror unit 14.

The traveling document reading mode and the both-sides reading mode are modes for reading document sheets set on the document tray 22 while automatically feeding the sheets one by one by means of the ADF 3. The image reading in the traveling document reading mode is performed using the CCD reading unit 11, whereas the image reading in the both-sides reading mode performed using both of the CCD reading unit 11 and the CIS 21. The maximum number of document sheets that can be set on the document tray 22 is 200, for example.

Figure 2:
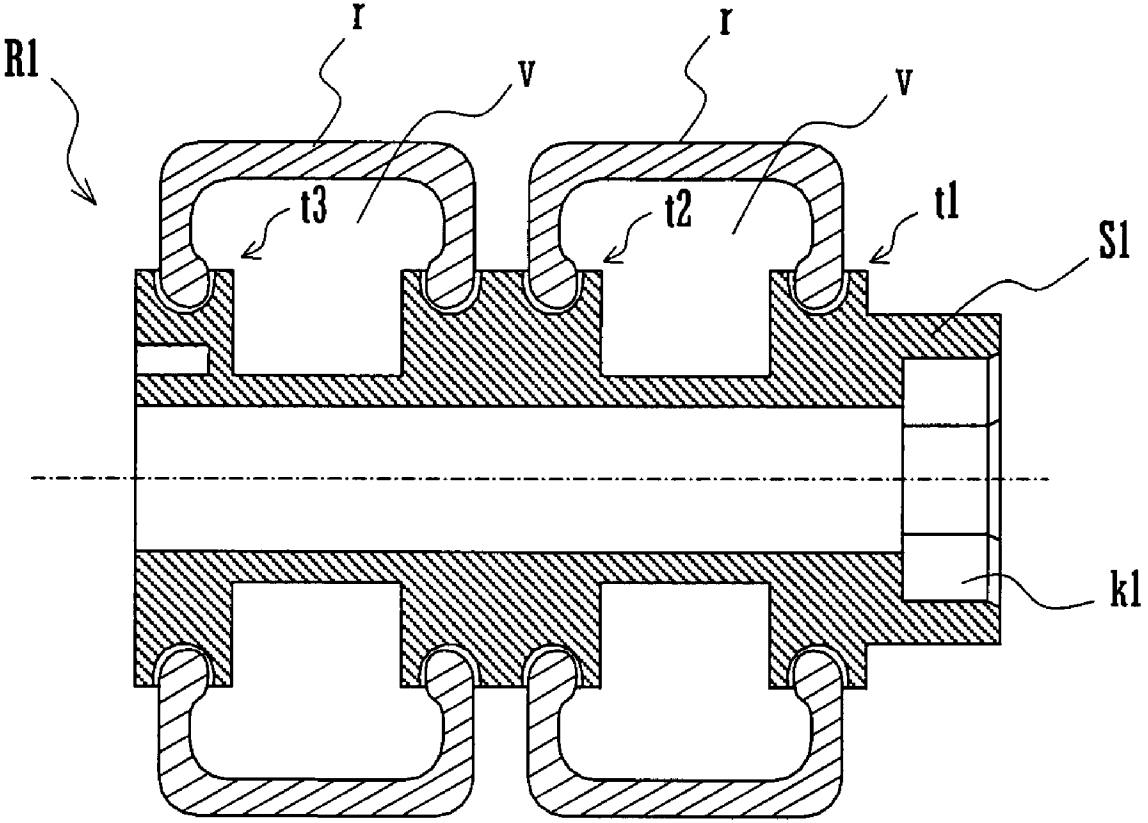
FIG. 2 is a sectional view showing a pickup roller used in the image reading apparatus.

FIG. 2 shows the structure of the pickup roller (corresponding to the sheet pickup section defined by the present invention) R1. In this embodiment, the pickup roller R1 is hollow. The pickup roller R1 includes a hollow support shaft S1 having an outer periphery formed with roller support portion t1 to t3 each protruding like a flange. A pair of roller members r,r each shaped like a hollow tire have root portions each tightly fitted in the peripheral groove of a respective one of the roller support portions t1 to t3 to define hollow portions v,v therein. The support shaft S1 has one end formed with a key groove k1. It is possible to use synthetic rubber or other elastic synthetic resin materials for each roller member r.

The use of such a hollow roller makes it possible to establish a lower and more uniform pressing force against a sheet than does a conventional solid-type pickup roller, as well as to increase the sheet contact area. Thus, the pickup roller R1 is capable of picking up only the sheet contacting the pickup roller R1 and hence reducing the frequency of occurrences of feed of plural sheets remaining superposed one upon another.

By combining the hollow pickup roller R1 with the reverse roller R2*a*, it is possible to reduce the frequency of occurrences of feed of plural sheets remaining superposed one upon another, lower the possibility that the reverse roller R2*a* rubs a sheet, inhibit the occurrence of staining of a sheet or trailing (stretching) of an image, and hence maintain the sheet in a good condition.

Figure 3:
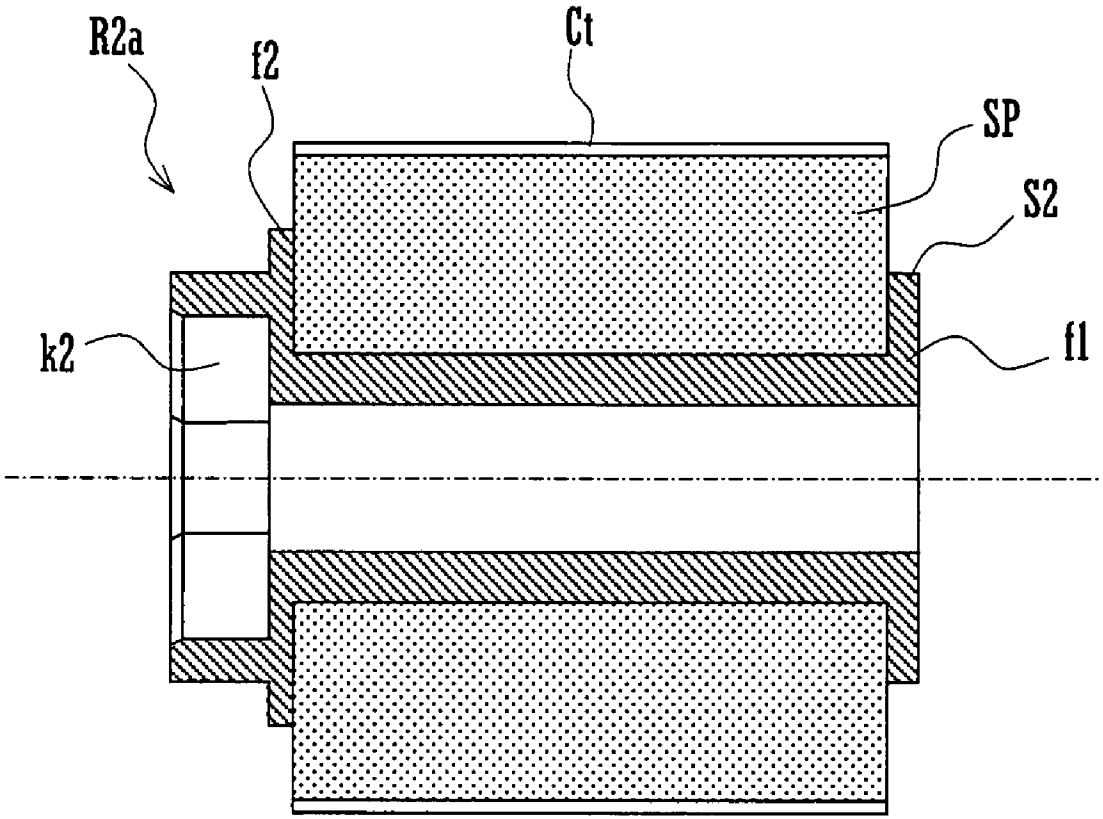
FIG. 3 is a sectional view showing a reverse roller used in the image reading apparatus.

FIG. 3 is a sectional view of the reverse roller R2*a*. As shown, the reverse roller R2*a* includes a sponge member SP having an outer periphery formed with a coating layer Ct having a surface smoothed to such an extent as to have a gloss. The sponge member SP is wrapped around the outer periphery of a hollow support shaft S1 having flanges f1 and f2 at opposite ends thereof. The coating layer Ct is formed from urethane rubber by a dipping process. The support shaft S2 has one end formed with a key groove k2.

This dipping process includes: dipping continuous reverse roller R2*a* into a urethane solution to form coating layer Ct; removing useless end portions; and cutting the continuous roller into individual reverse rollers R2*a*. Such a manufacturing process is capable of manufacturing a larger number of reverse rollers R2*a* with a high yield at reduced cost by more simplified working steps than required by the spraying process. Further, the dipping process can give the coating layer Ct having a higher surface smoothness than cases where the urethane solution is sprayed onto a matrix to form coating layer Ct.

Preferably, the coating layer Ct is set to have a thickness of about 0.15 mm. Also, the sponge member S preferably has a hardness of from 5 to 30 (in terms of Ascar C hardness, hereinafter the same). If the hardness is lower than this range, the coating liquid (urethane solution) penetrates into the sponge member SP to make the formation of the coating layer Ct difficult. Though the hardness of the sponge member S falls within the range from 20 to 30 according the manufacturing (dipping) technique of today, possible progress of the coating technique would make it possible to lower the hardness of the sponge member S.

Preferably, the material of the sponge member S is expanded acrylonitrile-butadiene rubber (NBR) having an Ascar C hardness of 30°. Alternatively, it is possible to use melamine sponge, CR rubber sponge, silicone sponge, urethane sponge, or the like. Also, a silicone material can be employed.

In the present embodiment, the surface of the coating layer Ct is smoothed sufficiently to such an extent as to have a gloss. By so doing, the coating layer Ct can be brought into contact with a sheet uniformly, have an increased contact area in which partial contact pressures are lowered and distributed uniformly. For this reason, in feeding a sheet bearing a document image, it becomes less likely that the reverse roller R2*a* rubs pencil power forming the image. Therefore, the occurrence of the trailing phenomenon of the image becomes less likely.

Figure 4:
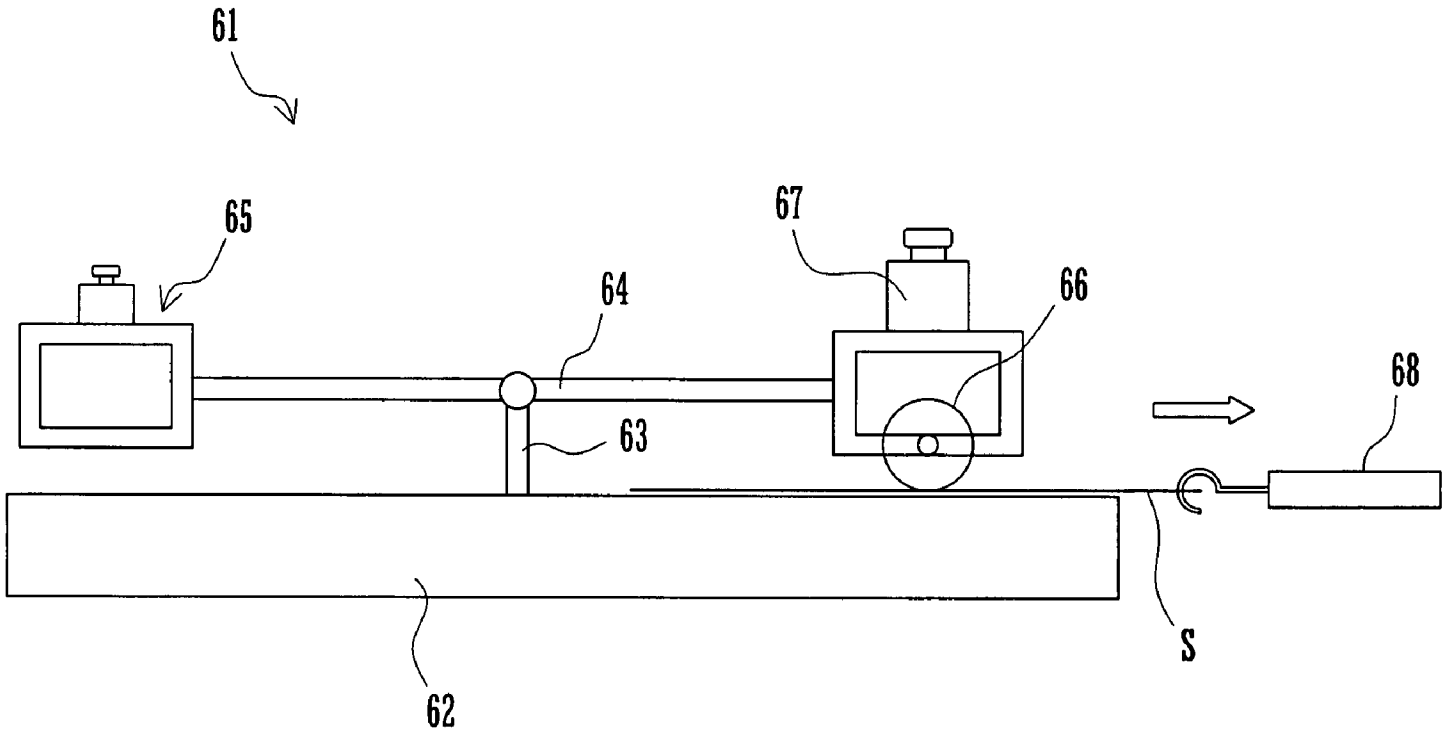
FIG. 4 is a view showing the structure of a measuring device for measuring a sheet pullout force.

FIG. 4 is a view showing the structure of a measuring apparatus 61 for measuring how much the surface smoothness of a roller (reverse roller) influences the sheet pullout force (frictional force) when the roller presses against a sheet. The measuring apparatus 61 includes a balance beam 64 pivotally supported by a support member 63 standing upright on a base 62 positioned substantially horizontally, the balance beam 64 having one end attached with a counterweight 65 and an opposite end fixedly supporting a roller 66 to be measured and carrying a replaceable weight 67 for giving the roller 66 a pressing force. The measuring apparatus 61 is configured to measure the tension obtained by pulling a sheet S by means of a tension gauge 68 with the roller 66 pressing against the sheet S placed on the base 62.

The sheet pullout force of a conventional reverse roller and that of the reverse roller of the present invention were measured by the measuring apparatus 61 and the results shown in FIG. 7 were obtained.

With the conventional EPDM elephant-skin abrasion finished roller (hardness 33), a pullout force of from 180 to 190 gf was required when the weight 67 was 200 gf and a pullout force of from 500 to 510 gf required when the weight 67 was 550 gf. With a comparative example comprising expanded NBR (hardness 30) with urethane coat (rough surface), a pullout force of from 160 to 170 gf was required when the weight 67 was 200 gf and a pullout force of from 420 to 430 gf required when the weight 67 was 550 gf.

In contrast, with the roller comprising expanded NBR (hardness 30) with urethane coat (glossy surface) according to the present invention, a pullout force of from 100 to 110 gf was required when the weight 67 was 200 gf and a pullout force of from 220 to 230 gf required when the weight 67 was 550 gf.

In actual use, a pressing force of about 550 gf is exerted on sheet S, but the roller smoothed to such an extent as to have a glossy surface according to the present invention can pull out sheet S with a pullout force about a half of the pulling force required by the conventional roller. Thus, the use of the reverse roller R2*a* comprising expanded NBR (hardness 30) with urethane coat (glossy surface) according to the present invention makes it possible to reduce the frictional force to be exerted on sheet S. For this reason, the present invention can prevent the image quality from degrading due to sheet S being stained or the image being made unclear by the trailing phenomenon which occurs if, for example, the image is written with pencil or has a low fixing property, and hence can handle sheets S favorably.

With a contact-type surface roughness meter, the surface roughness of each of the conventional roller, comparative example reverse roller and the reverse roller R2*a* of the present invention was measured, and the results of evaluation of the degree of stain caused by rubbing of a document image written with pencil by reverse roller R2*a* are shown in FIG. 8.

According to the results shown in FIG. 8, stain resulting from rubbing by the conventional EPDM elephant-skin abrasion finished roller was evaluated "x", which means not preferable, and stain resulting from rubbing by the comparative reverse roller comprising expanded NBR (hardness 30) with urethane coat (glossy but slightly rough surface) was evaluated "Δ", which means a somehow usable degree. In contrast, the reverse roller R2*a* of the present invention comprising expanded NBR (hardness 30) with urethane coat (glossy surface) was evaluated good ("◎ to ○").

Specifically, in FIG. 8, the evaluation "x" on stain represents a condition where the sheet is stained too conspicuously to use; the evaluation "Δ" represents a condition where the sheet is stained to such a low degree as to allow use somehow; and the evaluation "◎ to ○" represents a good condition where stain is not conspicuous. That is, "◎ to ○" means a preferable range and "Δ" means a usable condition. A value of roughness that is lower than the described range is not preferable because sound (squeal) is generated to cause unpleasant noise when the roller and the sheet slip with respect to each other, though the surface smoothness is increased to raise no stain problem.

It has been confirmed from the results shown in FIG. 8 that: the coating layer Ct preferably has a mean surface roughness Ra established to fall within the range of the formula (1):

$$0.09 \leqq Ra \leqq 0.11 \quad (1); \text{ and}$$

a maximum height Ry, a ten-points mean roughness Rz and a maximum roughness Rmax are each preferably established to fall within the range of a respective one of the following formulae (2) to (4):

$$0.46 \leqq Ry \leqq 0.60 \quad (2)$$

$$0.39 \leqq Rz \leqq 0.80 \quad (3)$$

$$13.20 \leqq Rmax \leqq 35.36 \quad (4).$$

By thus establishing, the surface of the coating layer can be smoothed to such an extent as to have a gloss. Accordingly, the sheet feeder can prevent the image quality from degrading due to the trailing (stretching) phenomenon of an image formed on a sheet surface which occurs if the image is written with pencil or has a low fixing property for example, or due to the sheet surface being stained or the image being made unclear, and hence can handle sheets favorably.

The results described above are greatly subject to values of mean surface roughness Ra, maximum height Ry and ten-points mean roughness Rz. Thus, it can be considered that as the surface of the coating layer Ct becomes smoother, the coating layer can contact a sheet more uniformly and have a larger contact area in which partial contact pressures are lowered and distributed uniformly and, hence, pencil powder forming the image is less likely to be rubbed off by the reverse roller R2*a*.

Figure 5:
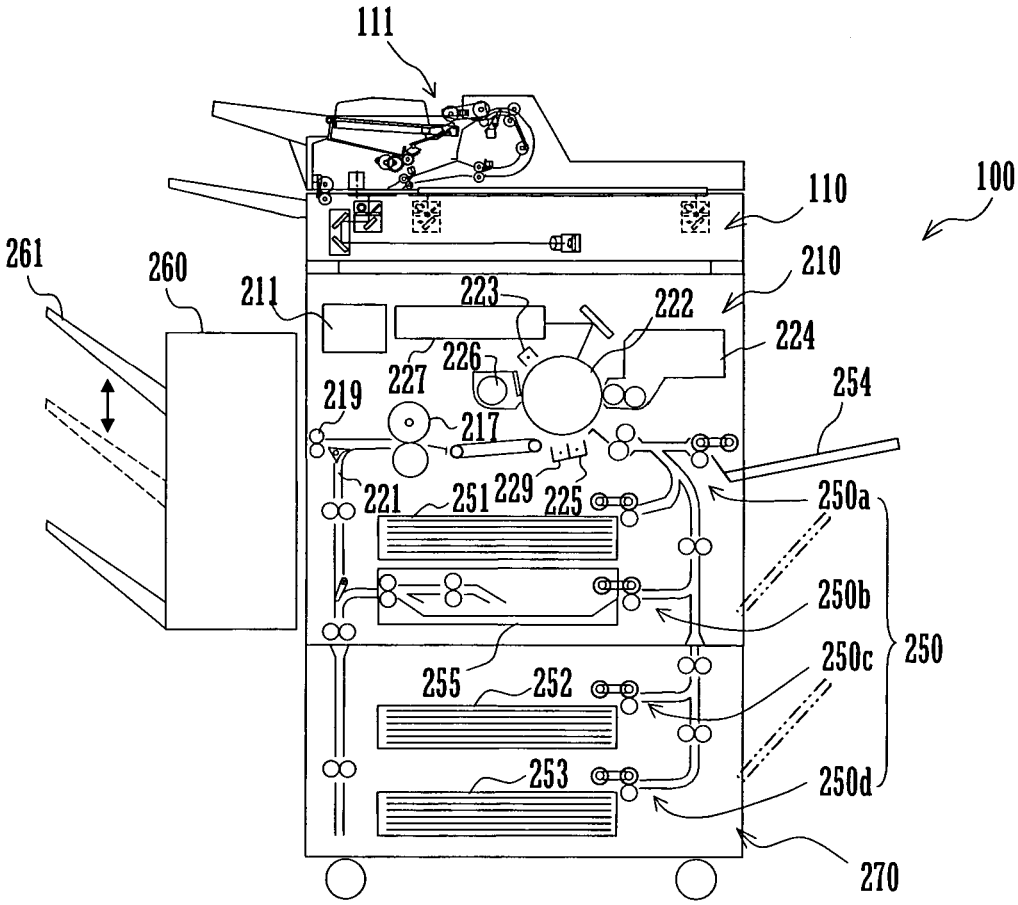
FIG. 5 is a view showing the construction of an image forming apparatus.
Figure 6:
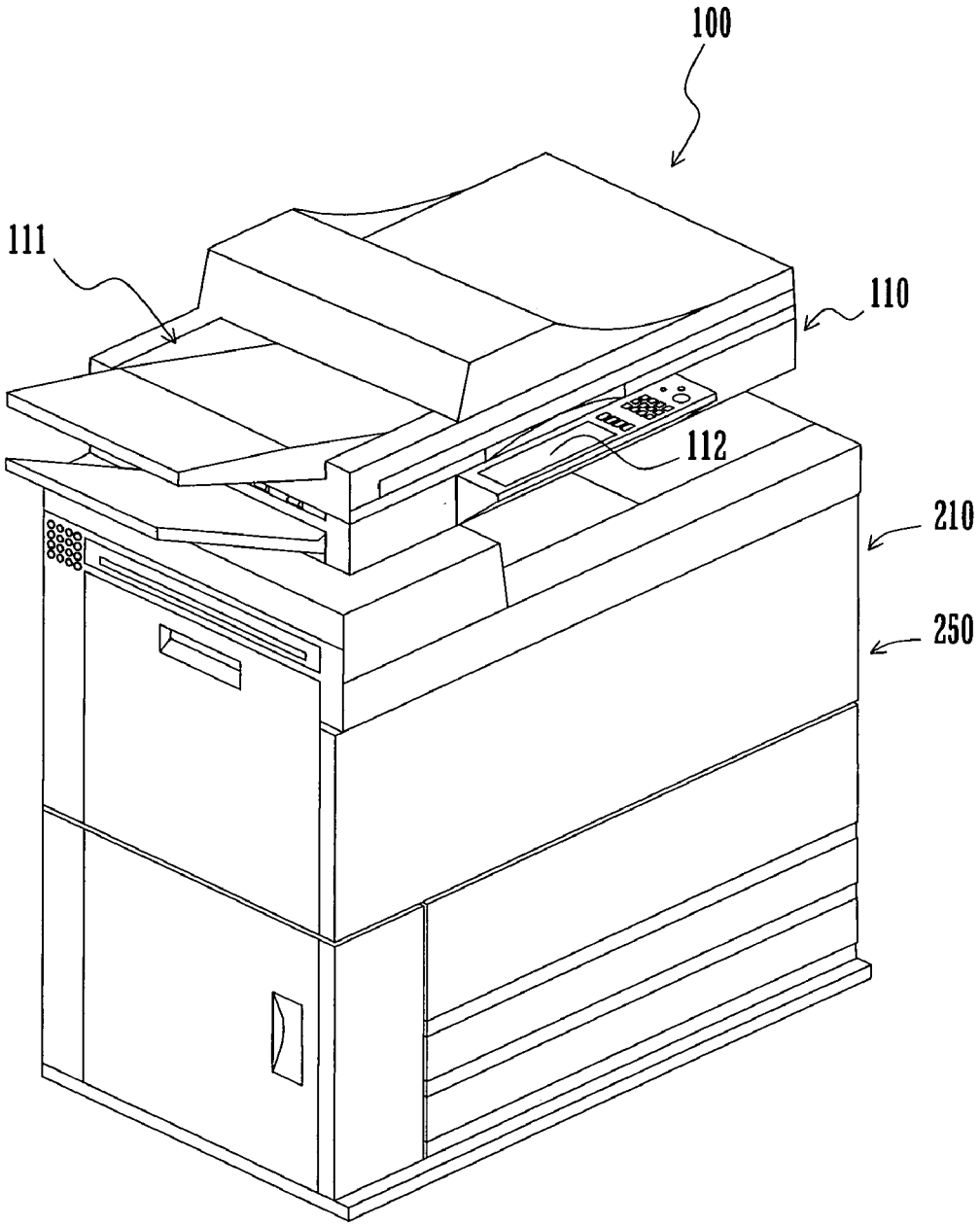
FIG. 6 is a perspective view of the image forming apparatus.

FIG. 5 schematically illustrates the construction of a digital multifunction machine 100 as another embodiment of image forming apparatus according to the present invention. In the digital multifunction machine 100, a document image read at a reading section (document reading apparatus) 110 is transmitted as image data to a non-illustrated image data input section. After having undergone predetermined image processing, the image data is temporarily stored in memory provided in an image processing section. The image data in the memory is read out in response to an output instruction and then transferred to a laser writing unit 227 as an optical writing device provided in an image forming section (the image forming section defined by the present invention) 210. As shown in FIG. 6, an ADF 111 is mounted on the reading section (document reading apparatus) 110, and a control panel 112 is provided on the operating side.

The laser writing unit 227 comprises: a semiconductor laser light source for emitting laser light in accordance with image data read out of the memory or transferred from an external device; a polygon mirror for deflecting laser light by rotation at a constant angular velocity; an f-θ lens for performing correction so that the laser light deflected at a constant angular velocity is deflected at a constant angular velocity on a photosensitive drum 222; and other components. Although the laser writing unit is used as the writing device in this embodiment, use may be made of an optical writing head unit of a solid-state scanning type which comprises an array of light emitting elements such as LEDs or EL devices.

The image forming section 210 further includes, around the photosensitive drum 222, an electrostatic charger 223 for electrostatically charging the photosensitive drum 222 to a predetermined potential, a developing device 224 for supplying toner onto an electrostatic latent image formed on the photosensitive drum 222 to develop the latent image into a visible image, a transfer device (e.g. transfer charger) 225 for transferring the toner image formed on the surface of the photosensitive drum 222 to a sheet, a cleaner 226 for recovering excess toner, and a static charge eliminator (e.g. charger for eliminating static charge) 229. The sheet bearing the image transferred thereto at the image forming section 210 is then fed to a fixing unit 217, where the image is fixed to the sheet.

On the ejection side of the image forming section 210 are provided, besides the aforementioned fixing unit 217, a switchback path 221 for inverting the sheet front side back for formation of an image on the reverse surface of the sheet, and a post-processing device 260 which is provided with an up-and-down tray 261 and performs stapling or other processing on sheets bearing respective images formed thereon. The sheet to which a toner image has been fixed at the fixing unit 217 is guided to the post-processing device 260 by a sheet ejecting roller 219 optionally through the switchback path 221, subjected to appropriate post-processing, and then ejected.

Below the image forming section 210 is provided a sheet feed section which comprises a manual feed tray 254, a reversing unit 255 and a recording sheet tray 251 which are provided on or in the apparatus body, and sheet feed trays 252 and 253 provided in a multi-tier sheet feed section 270. The sheet feed section further includes transport means 250 for transporting a recording sheet fed from any one of the trays 251, 252, 253 and 254 to a transfer position in the image forming section 210 where the transfer device is located.

The reversing unit 255, which communicates with the switchback path 221 for inverting each sheet, is used in forming images on both sides of the sheet. The reversing unit 255 is so configured that it can be replaced with an ordinary recording sheet cassette. Therefore, an arrangement is possible where such an ordinary recording sheet cassette is provided instead of the reversing unit 255.

The digital multifunction machine 100 thus constructed may be provided with the sheet feeder 51 shown in FIG. 1 in the transport means 250, i.e. 250*a*, 250*b*, 250*c* and 250*d*.

The image reading apparatus is not limited to the construction shown in FIG. 1. The present invention is applicable to any image reading apparatus irrespective of the construction and type thereof as along as the image reading apparatus can include a sheet feeder comprising: at least, a sheet accommodating section configured to accommodate therein a stack of sheets; a sheet pickup section configured to contact the stack of sheets and feed the sheets toward a feed path; and sheet separator comprising a feed roller and a reverse roller which are located downstream of the sheet pickup section and abut against each other, and other components.

Moreover, the image forming apparatus is not limited to the construction shown in FIGS. 5 and 6. The present invention is applicable to any image forming apparatus irrespective of the construction and type thereof as along as the image forming apparatus can include a sheet feeder comprising: at least, a sheet accommodating section configured to accommodate therein a stack of sheets; a sheet pickup section configured to contact the stack of sheets and feed the sheets toward a feed path; and sheet separator comprising a feed roller and a reverse roller which are located downstream of the sheet pickup section and abut against each other, and other components.

The invention claimed is:

1. A sheet feeder, comprising:

a sheet accommodating section configured to accommodate therein a stack of sheets;

a sheet pickup section configured to contact the stack of sheets and feed the sheets toward a feed path; and sheet separator located downstream of the sheet pickup section, the sheet separator including a feed roller and a reverse roller, wherein the reverse roller includes a sponge member having an outer periphery formed with a coating layer having a surface smoothed to such an extent as to have a gloss, and wherein the coating layer has a mean surface roughness Ra satisfying the following formula:

$$0.09 \leqq Ra \leqq 0.11;$$

and a maximum height Ry, a ten-points mean roughness Rz and a maximum roughness Rmax that fall within the range of the following formulae:

$$0.46 \leqq Ry \leqq 0.60$$

$$0.39 \leqq Rz \leqq 0.80$$

$$13.20 \leqq Rmax \leqq 35.36.$$

2. The sheet feeder according to claim 1, wherein the coating layer is formed by dipping the sponge member into a coating liquid.

3. The sheet feeder according to claim 1, wherein the coating layer comprises urethane rubber.

4. The sheet feeder according to claim 1, wherein the sheet pickup section comprises a roller member having a hollow portion therein.

5. An image reading apparatus, comprising:

a sheet feeder as recited in claim 1; and an image reading section configured to read an image formed on each of the sheets fed by the sheet feeder.

6. An image forming apparatus, comprising:

an image reading apparatus as recited in claim 5; and an image forming section configured to form an image based on image data read by the image reading apparatus.

7. An image forming apparatus, comprising:

a sheet feeder as recited in claim 1;

an image reading section configured to read an image formed on each of the sheets fed by the sheet feeder; and an image forming section configured to form an image based on image data read by the image reading section.

* * * * *